US008879777B2

(12) United States Patent
Epping

(10) Patent No.: US 8,879,777 B2
(45) Date of Patent: Nov. 4, 2014

(54) DYNAMIC ELECTROACOUSTIC TRANSDUCER

(71) Applicant: Sennheiser electronic GmbH & Co. KG, Wedemark (DE)

(72) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 13/962,033

(22) Filed: Aug. 8, 2013

(65) Prior Publication Data

US 2014/0146994 A1 May 29, 2014

(30) Foreign Application Priority Data

Aug. 10, 2012 (DE) ..... 10 2012 214 263

(51) Int. Cl.
*H04R 9/04* (2006.01)
*H04R 9/08* (2006.01)

(52) U.S. Cl.
CPC ..... *H04R 9/04* (2013.01); *H04R 9/045* (2013.01); *H04R 9/08* (2013.01)
USPC ..... 381/398; 381/423

(58) Field of Classification Search
CPC ..... H04R 9/04; H04R 9/08; H04R 9/045
USPC ..... 381/398, 400, 403, 405, 424, 431, 432, 381/433, 361; 181/157, 163–165
See application file for complete search history.

(56) References Cited

U.S. PATENT DOCUMENTS

| | | | | |
|---|---|---|---|---|
| 2004/0188174 | A1* | 9/2004 | Sahyoun | 181/157 |
| 2004/0195039 | A1* | 10/2004 | Sahyoun | 181/157 |
| 2007/0125591 | A1* | 6/2007 | Sahyoun | 181/157 |
| 2010/0183173 | A1 | 7/2010 | Teske-Fischer et al. | |

FOREIGN PATENT DOCUMENTS

| | | |
|---|---|---|
| DE | 11 29 538 | 5/1962 |
| DE | 29 43 054 | 5/1981 |
| DE | 10 2007 005 620 | 8/2008 |
| EP | 0914020 | 5/1999 |

* cited by examiner

*Primary Examiner* — Tuan D Nguyen
(74) *Attorney, Agent, or Firm* — Frommer Lawrence & Haug LLP

(57) ABSTRACT

There is provided a dynamic electroacoustic transducer comprising a diaphragm and an oscillator coil which is fixed to the diaphragm in an oscillator coil portion. The diaphragm has a first portion within the oscillator coil portion and a second portion between the oscillator coil portion and an edge of the diaphragm. The diaphragm has at least one stiffening portion in the region of the second portion, which is of a different stiffness from the second portion of the diaphragm. The stiffening portion is of a such a configuration that a wobble movement of the diaphragm is substantially compensated.

6 Claims, 2 Drawing Sheets

DYNAMIC ELECTROACOUSTIC TRANSDUCER

The present application claims priority from German Patent Application No. DE 10 2012 214 263.0 filed on Aug. 10, 2012, the disclosure of which is incorporated herein by reference in its entirety.

FIELD OF THE INVENTION

The present invention concerns a dynamic electroacoustic transducer.

It is noted that citation or identification of any document in this application is not an admission that such document is available as prior art to the present invention.

Dynamic electroacoustic transducers are used for example in microphones or in headphones for detecting or reproducing audio signals.

A dynamic electroacoustic reproduction transducer typically comprises a diaphragm with a oscillator coil and a magnet system. The oscillator coil is also moved by the oscillation of the diaphragm, whereby there is an interaction with the magnet system, which can be electrically measured. In the case of dynamic electroacoustic transducers however it can happen that there is an asymmetry in the diaphragm and that can lead to unwanted wobbling of the diaphragm.

In the German patent application from which priority is claimed the German Patent and Trade Mark Office searched the following documents: DE 29 43 054 A1, DE 10 2007 005 620 A1, DE 11 29 538 B and EP 0 914 020 A2.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

Therefore an object of the present invention is to provide a dynamic electroacoustic transducer which has a reduced susceptibility to diaphragm wobble and flutter.

Thus there is provided a dynamic electroacoustic transducer comprising a diaphragm and an oscillator coil which is fixed to the diaphragm in an oscillator coil portion. The diaphragm has a first portion within the oscillator coil portion and a second portion between the oscillator coil portion and an edge of the diaphragm. The diaphragm has at least one stiffening portion in the region of the second portion, which is of a different stiffness from the second portion of the diaphragm. The stiffening portion is of a such a configuration that a wobble movement of the diaphragm is substantially compensated.

According to an aspect of the present invention the stiffening portion is provided opposite from the region where contacting of the oscillator coil is effected by an oscillator coil wire.

The invention also concerns a microphone having an above-described dynamic electroacoustic transducer.

The invention also concerns an earphone having at least one above-described dynamic electroacoustic transducer.

The invention concerns the notion that an asymmetry of the oscillatable system comprising diaphragm and oscillator coil can be produced by coil wires which are taken out at one side (for coil contacting). The aim is to provide an oscillator system having an improved symmetrical structure, to reduce the tendency to wobble and flutter.

The invention is further based on the realization that a diaphragm or the oscillator system of the dynamic transducer should move in piston-like fashion. If however the oscillator coil is contacted by a coil wire coil wire placement at one side can be involved. The consequence of this can be that the diaphragm no longer oscillates in a piston-like fashion. For example the maximum of the amplitude of the oscillation of the oscillator system can be in the region opposite the coil contacting. Thus, due to the asymmetric oscillation characteristic, there can be at least one wobble mode, that is to say it can happen that, besides the resonance frequency, there is a further frequency at which the amplitude is higher than in comparison with adjacent similar frequencies. A corresponding consideration applies to the phase angle which can be considerably deflected in a wobble mode.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

According to the invention the dynamic electroacoustic transducers have a magnet system with an air gap in which an oscillator coil can oscillate. The oscillator coil is connected with a first end to the diaphragm and the second end oscillates in the air gap.

Figure 1:
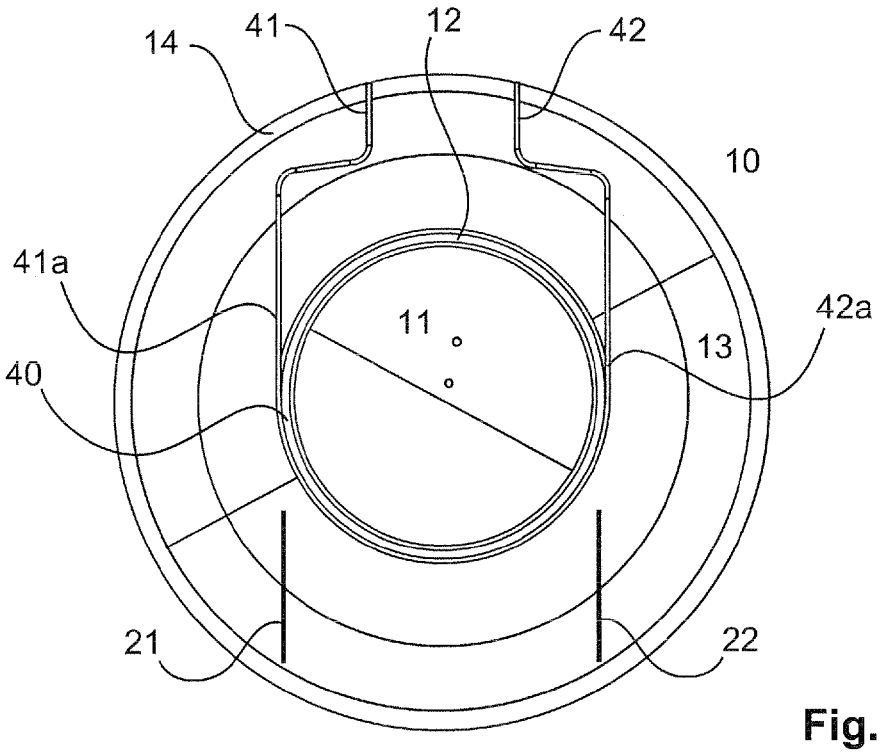
FIG. 1 shows a diagrammatic view of an oscillator system for a dynamic electroacoustic transducer according to a first embodiment.

FIG. 1 shows a diagrammatic view of an oscillator system for a dynamic electroacoustic transducer according to a first embodiment. The diaphragm 10 can be for example of a round configuration. The diaphragm has a first portion 11 which is surrounded by the oscillator coil 12. the diaphragm 10 further has a second portion 13 extending between the oscillator coil 12 and the edge 14 of the diaphragm. The oscillator coil 12 is contacted by way of the feed lines 41 and 42. In particular the oscillator coil 12 is contacted by way of first ends 41*a*, 42*a* of the feed lines 41, 42.

The diaphragm 10 has a third and a fourth portion 20, 21 which respectively extend from the edge 14 of the diaphragm 10 towards the oscillator coil 12. Those portions 20, 21 are for example straight and serve to stiffen the diaphragm 10 in strip form. Accordingly the third and fourth portions 20, 21 are stiffer than the second portion. The portions 20 and 21 are disposed opposite from the feed lines 41 and 41.

The portions 21, 22 can be respectively disposed on the same tangents as the first ends 41*a*, 42*a* of the feed lines 41, 42.

The feed lines 41, 42 can be straight in the region of the first ends 41*a*, 42*a*. Optionally in the region of the first ends 41*a*, 42*a* the feed lines 41, 42 can be arranged in tangential relationship with the circular oscillator coil 12.

The greater stiffness of the diaphragm in the third and fourth portions can be achieved for example by a greater diaphragm thickness. In that case for example material can be provided on the third and fourth portions (for example by being glued thereon, by being sputtered thereon or the like). The third and fourth portions 21, 22 can also be in the form of grooves of such dimensions that this provides for stiffening the diaphragm in those portions so that it is possible to compensate for an influence on the part of the coil wire contacting on the oscillator characteristic of the diaphragm. In particular the diaphragm should again oscillate in piston-like fashion.

Optionally the arrangement of the stiffening portions 21, 22 can be mirror-symmetrical relative to the first ends 41*a*, 42*a* of the feed lines 41, 42. That can be effected in order to compensate for the wobble tendency of the diaphragm, produced by attachment of the feed lines.

Figure 2:
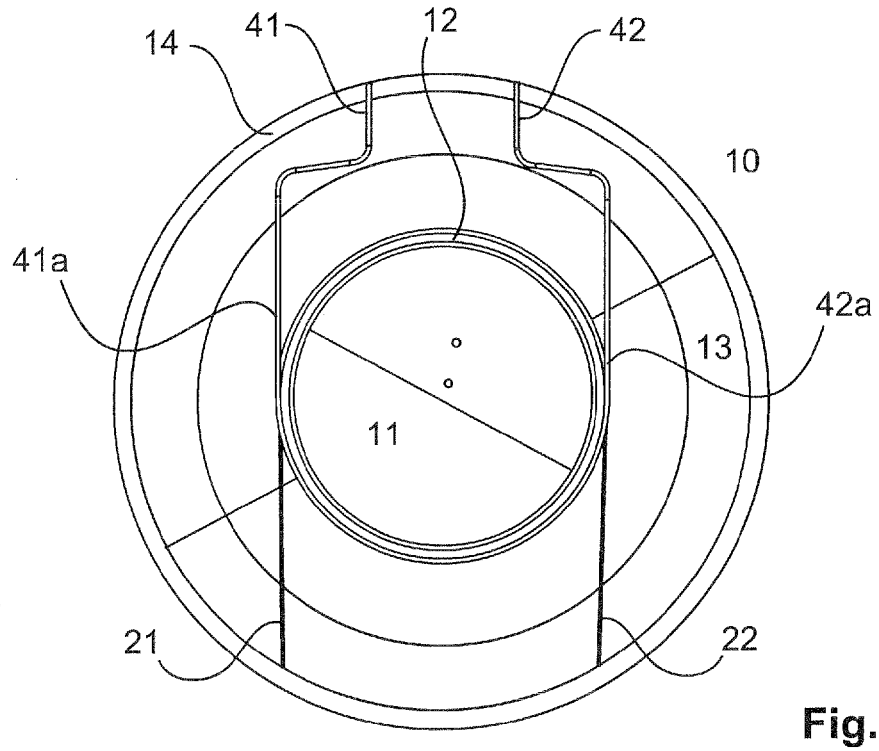
FIG. 2 shows a diagrammatic view of an oscillator system for a dynamic electroacoustic transducer according to a second embodiment.

FIG. 2 shows a diagrammatic view of an oscillator system for a dynamic electroacoustic transducer according to a second embodiment. In this case the oscillator system of the second embodiment substantially corresponds to the system of the first embodiment. While the portions 20 and 21 of the first embodiment do not extend as far as the oscillator coil 12 the portions 21 and 22 of the second embodiment can extend to or to shortly before the oscillator coil 12.

Figure 3:
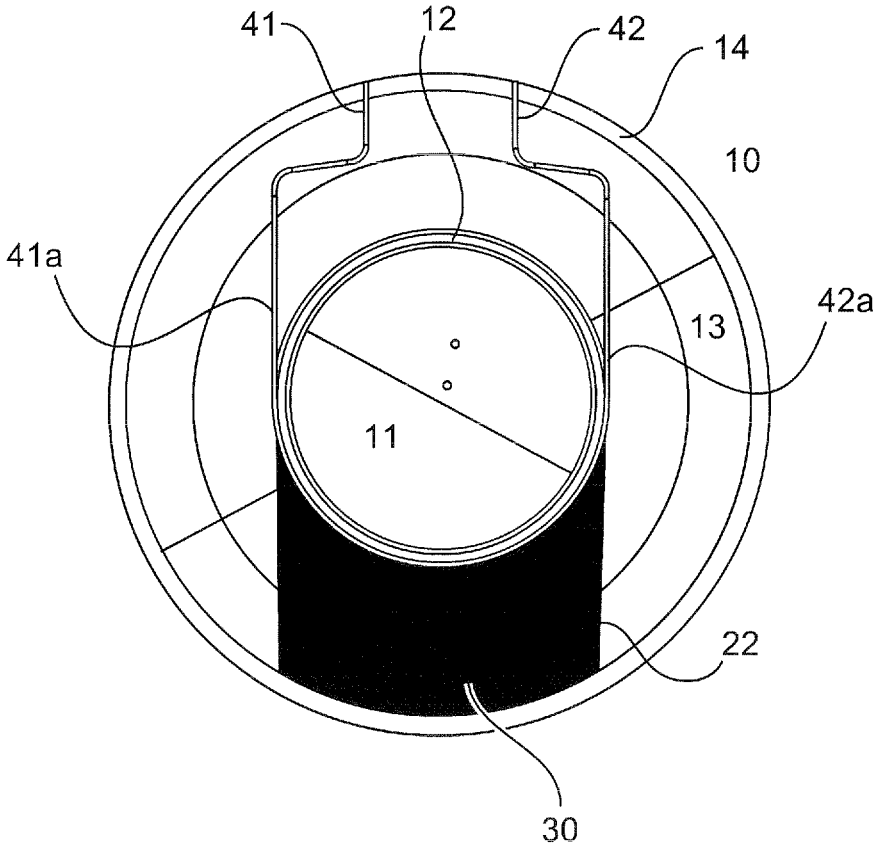
FIG. 3 shows a diagrammatic view of an oscillator system for a dynamic electroacoustic transducer according to a third embodiment.

FIG. 3 shows a diagrammatic view of an oscillator system of a dynamic electroacoustic transducer according to a third embodiment. The diaphragm 10 is for example round and has a first portion 11 surrounded by the oscillator coil portion 12. There is also a second portion 13 between the oscillator coil portion 12 and an edge 14 of the diaphragm. The oscillator coil 12 is contacted by way of the feed lines 41 and 42. The configuration of the feed lines 41, 42 of the third embodiment can correspond to the configuration of the feed lines 41, 42 of the first embodiment.

In addition the diaphragm can have a stiffening portion 30 adapted to stiffen the diaphragm 10 at least in that region. In that case the portion 30 can be of greater diaphragm thickness than the portion 13. That can be effected for example by embossing on additional thin films, by sputtering material on the diaphragm, by stiffening the diaphragm by the introduction of a structure (embossing of the diaphragm) or the like.

The stiffening portion 30 can correspond to that region that is delimited by the portions 21, 22.

The invention is based on the notion of at least portion-wise altering (for example increasing) the stiffness of the diaphragm to compensate for an influence in respect of the diaphragm oscillation characteristic by virtue of coil wire contacting. The desired piston-form oscillation of the diaphragm can then be achieved in that way.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A dynamic electroacoustic transducer comprising:
a diaphragm; and
an oscillator coil which is fixed to the diaphragm in an oscillator coil portion;
a feed line configured to contact the oscillator coil by way of first ends of the feed line;
wherein the diaphragm has;
a first portion within the oscillator coil portion; and
a second portion between the oscillator coil portion and the edge of the diaphragm;
wherein the diaphragm has at least one stiffening portion in the region of the second portion;
wherein the stiffening portion is of a different stiffness from the second portion of the diaphragm; and
wherein the stiffening portion is configured to substantially compensate for a wobble movement of the diaphragm.

2. The transducer as set forth in claim 1;
wherein the stiffening portion is provided opposite from the region where contacting of the oscillator coil is effected by an oscillator coil wire.

3. The transducer as set forth in claim 1;
wherein the oscillator coil is of a circular configuration.

4. The transducer as set forth in claim 1;
wherein the second portion of the diaphragm has a first and a second stiffening portion;
wherein the first ends contact the oscillator coil on one side of the first portion and the first and second stiffening portions are arranged on an other side of the first portion.

5. A microphone comprising;
a dynamic transducer as set forth in claim 1.

6. An earphone comprising;
at least one dynamic electroacoustic transducer as set forth in claim 1.

* * * * *